United States Patent [19]

Hill et al.

[11] Patent Number: 4,501,409

[45] Date of Patent: Feb. 26, 1985

[54] TILT VALVE

[75] Inventors: James J. Hill, Plantation; Al Marven, Hollywood, both of Fla.

[73] Assignee: Cook International, Inc., Palm Beach, Fla.

[21] Appl. No.: 442,674

[22] Filed: Nov. 18, 1982

[51] Int. Cl.[3] ..... F16K 31/00; B65D 83/00

[52] U.S. Cl. ..... 251/354; 251/337; 222/402.22; 267/180

[58] Field of Search ..... 222/402.21, 402.22, 222/402.23, 513; 251/348, 354, 337, 349; 267/180

[56] References Cited

U.S. PATENT DOCUMENTS

| | | | |
|---|---|---|---|
| 2,582,262 | 1/1952 | Loven et al. | 251/354 |
| 2,650,617 | 9/1953 | Wasser | 267/180 |
| 2,852,168 | 9/1958 | Suellentrop | 222/402.22 |
| 3,060,965 | 10/1962 | Taggart | 251/354 |
| 3,506,241 | 4/1970 | Ewald | 251/354 |
| 3,531,086 | 9/1970 | Shannon | 251/356 |
| 3,547,405 | 12/1970 | Ewald | 251/354 |
| 3,572,557 | 3/1971 | Graham et al. | 222/402.22 |
| 3,575,323 | 4/1971 | Steinman | 222/402.21 |
| 3,642,180 | 2/1972 | Lehmann | 222/402.23 |
| 3,675,823 | 7/1972 | Steiman | 222/402.22 |
| 3,907,176 | 9/1975 | Harris | 222/402.22 |
| 4,354,621 | 10/1982 | Knickerbocker | 222/402.22 |

FOREIGN PATENT DOCUMENTS

| | | | |
|---|---|---|---|
| 2215605 | 10/1972 | Fed. Rep. of Germany | 251/354 |

*Primary Examiner*—A. Michael Chambers

*Attorney, Agent, or Firm*—Oblon, Fisher, Spivak, McClelland & Maier

[57] ABSTRACT

A tilt valve for an aerosol can is constructed so that it can be actuated only by transverse tilting forces. An output valve stem assembly is sealed to a valve housing whose inlet communicates with the interior of the aerosol can. A tilt element is biased against the bottom of the output valve assembly so as to seal the interior of the valve housing. A barrel-shaped spring is used to bias the tilt element so that the resistance of the output stem to tilting, and the stroke required for actuation, are reduced. The input stem and the bottom of the tilt element provide a secondary valve which is closed upon the output stem being subject to downward axial forces. Therefore, only transverse forces provided by an automatic actuating device can be used to actuate the tilt valve assembly.

15 Claims, 12 Drawing Figures

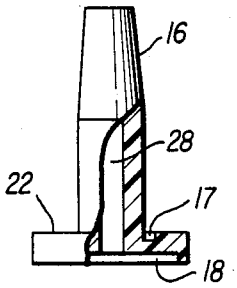
FIG. 5
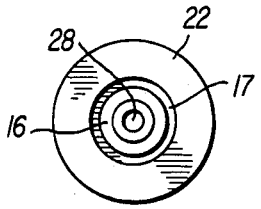
FIG. 6
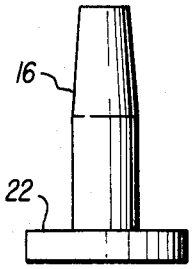
FIG. 7
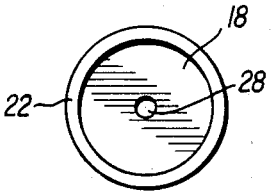
FIG. 8
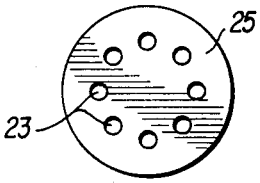
FIG. 9
FIG. 10
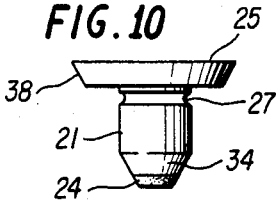
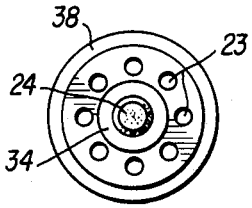
FIG. 11
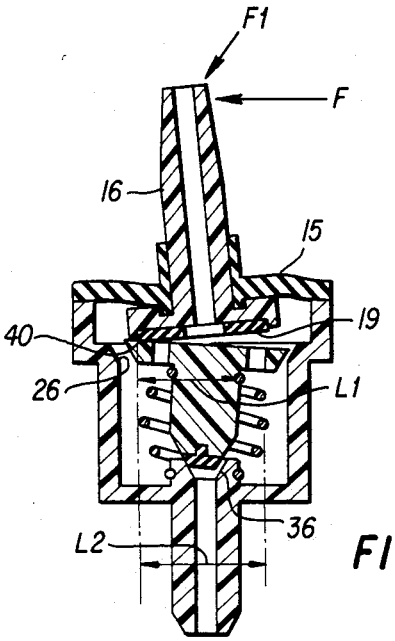
FIG. 12

TILT VALVE

BACKGROUND OF THE INVENTION

1. Field of the Invention

The present invention relates in general to spray valves affixed within the tops of aerosol cans for the purpose of generating and delivering a mist of spray from the interior of the can to a nozzle of the spray valve. More particularly, the present invention relates to a tilt type of spray valve assembly which is actuated by an automatic actuator.

2. Description of the Prior Art

It is often desirable to attach automatic spray actuators to aerosol cans having integral spray valves. The automatic spray actuators can, for example, intermittently actuate the spray valve for predetermined time periods at predetermined intervals, as may be necessary in the dispensing of insecticides. However, difficulties have arisen in the design of the actuators due to the spray actuation characteristics of the spray valve of the aerosol cans. For example, it is desirable to minimize both the stroke distance for actuating the spray valve and the amount of pressure which must be applied by the automatic actuating device, since reduced stroke and pressure result in smaller and simplified structures for the automatic actuating devices.

It has been known to provide automatic actuating devices for spray valves of aerosol cans in which the automatic actuating devices tilt, rather than depress, the spray valve. However, known tilt-type spray valves were designed for manual finger operation, rather than the precise and rigid requirements of automatic actuating devices. Therefore, under repeated automatic actuation, they suffered from several shortcomings. First, the output stem of the tilt-type spray valves were made of semi-rigid plastic material supported by a flat rubber or neoprene disk-like washer retainer. The output stem distorted in shape after several cycles of operation and could no longer retain its shape or vertical position within the can valve opening. Therefore, the output stem tended to remain in the tilted or "on" position of actuation and failed to shut off the output flow from the pressurized can. Moreover, the nozzle spring and seal design of the known tilt-type valve assemblies required a considerable amount of pressure for actuation, resulting in the aforementioned increase in size and complexity for the automatic actuating device. Finally, the known spray device is required a long lateral stroke for full spray output operation of the nozzle. This long lateral stroke not only required a more complex actuator, but also greatly reduced the activation sensitivity of the spray valve assembly. A further problem associated with the long lateral stroke was that the round stem hole of the neoprene output stem seal became distorted and elongated, thus permitting leaking of pressure and liquid from around the valve stem at the point of exit through the seal.

It is therefore desirable to provide a spray valve for an aerosol can which is simple in construction, inexpensive to manufacture, reliable in operation and compatible with automatic actuating devices.

SUMMARY OF THE INVENTION

A primary object of the present invention is the provision of a tilt valve assembly which is readily mountable within standard available valve mounting caps, is leakproof and tightly sealed within the mounting caps of aerosol can cap assemblies.

Another object of the present invention is the provision of a tilt valve assembly which can be actuated with a minimum of pressure.

Yet another object of the present invention is the provision of a tilt valve assembly which is operable with a minimum stroke angle.

Still another object of the invention is the provision of a tilt valve assembly which can only be operated by tilt action.

Another object of the invention is the provision of an output nozzle fabricated from a rigid material such as metal, hardened plastic or a similar substance which retains its form or shape after repeated actuations.

Another object of the invention is the provision of a tilt valve assembly with stop means to limit the angular stroke of the output nozzle stem in order to prevent the over travel of the nozzle stem.

According to the present invention, a tilt valve for an aerosol can is constructed so that it can be actuated only by transverse tilting forces. An output valve stem assembly is sealed to a valve housing whose inlet communicates with the interior of the aerosol can. A tilt element is biased against the bottom of the output valve assembly so as to seal the interior of the valve housing. A barrel-shaped spring is used to bias the tilt element so that the resistance of the output stem to tilting, and the stroke required for actuation, are reduced. The input stem and the bottom of the tilt element provide a secondary valve which is closed upon the output stem being subject to downward axial forces. Therefore, only transverse forces provided by an automatic actuating device can be used to actuate the tilt valve assembly.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein:

FIG. 5 is a view, partially in section, of the output nozzle stem;

FIG. 6 is a top view of the output nozzle stem;

FIG. 7 is similar to FIG. 5 without the portion shown in section;

FIG. 8 is a bottom view of the output nozzle with the bottom seal removed;

FIG. 9 is a top view of the shut off tilt element;

FIG. 10 is a side view of the shut off tilt element;

FIG. 11 is a bottom view of the shut off tilt element; and

FIG. 12 is a view similar to that of FIG. 2 but with the valve in an actuated position.

DETAILED DESCRIPTION OF THE PREFERRED EMBODIMENTS

Figure 1:
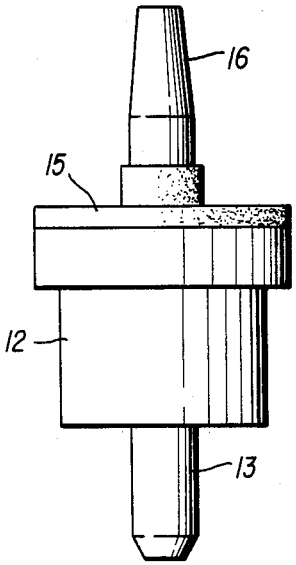
FIG. 1 is a front view of the assembled tilt valve mechanism of the present invention.

The preferred embodiment of the present invention will now be described with reference to the attached figures wherein the same reference numerals are used for the same elements throughout the several views. All of the elements of the tilt valve assembly, unless otherwise indicated, are formed of a rigid plastic material.

Figure 2:
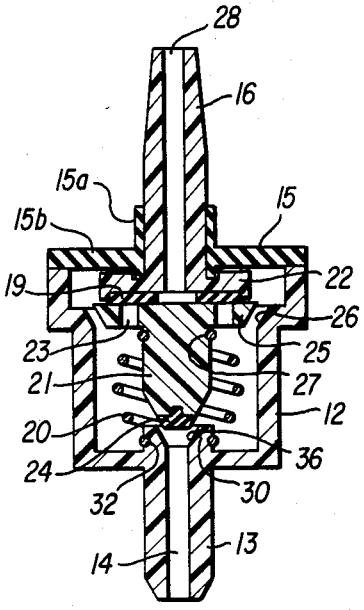
FIG. 2 is a cross section of the tilt valve assembly as seen in FIG. 1.
Figure 3:
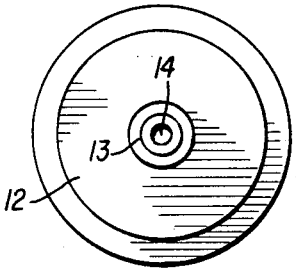
FIG. 3 is a bottom view of the tilt valve assembly.
Figure 4:
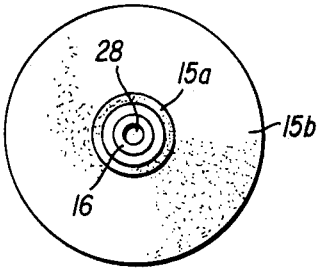
FIG. 4 is a top view of the tilt valve assembly with the output valve and the can seal installed.

As best seen in FIG. 1, the tilt valve assembly is provided with a cylindrical main valve body 12 having a lower, smaller diameter portion and an upper, larger diameter portion. As seen in FIG. 2, the main body 12 is hollow with a cylindrical interior whose shape corresponds to that of the exterior of the main valve body. A hollow input stem 13 is integrally formed on the bottom of the main valve body 12. An axial bore 14 extending through the input stem 13 connects the interior of the main body with the pressurized fluid within the interior of the aerosol can on which the valve assembly is mounted. A dip tube may be attached to the stem for supplying liquid to the interior of the main valve body 12.

A valve output stem assembly is best seen in FIGS. 1, 2 and 4–8. The output nozzle stem 16 is provided with an axial bore 28 extending therethrough. An output nozzle stem flange 22 is integrally formed on the bottom of the stem 16. An annular groove 17 is formed in top of the flange 22 in the area surrounding the connection to the stem 16. The bottom of the flange 22 is provided with a preferably circular washer counter bore 18 in which an elastomeric washer 19 may be positioned (FIG. 2).

A rubber gland seal 15 includes a collar 15*a* mounted on the lower end of the stem 16. The lower edge of the collar 15*a* fits in the annular groove 17 to form a fluid tight fitting. A radial portion 15*b* of the gland seal 15 is bonded to the top edge of the housing 12, in a fluid-tight manner. The valve output stem 16 and rubber gland seal 15 accordingly form a fluid tight cover for the interior of the main valve body 12 so that fluid can be discharged only through the bore 28 of the stem 16.

A tilt element 21 is positioned within the main valve body 12, as best seen in FIG. 2. The tilt element 21 includes a transverse flange 25 at the top thereof. A plurality of apertures 23 extend through the flange 25 as best seen in FIGS. 2, 9 and 11. The top of the flange is normally pressed against the washer seal 19 so that the orifices 23 are closed by the washer seal 19. Accordingly, the tilt element 21 normally prevents communication between the fluid in the interior of the main valve body and the bore 28 of the stem 16.

The metal spring 20 biases the tilt element 21 upward so that the top of the flange 25 is in sealing contact with the valve output stem assembly. The upward movement of the tilt element 21 and the valve output stem assembly is limited by the resilience of the rubber gland seal 15 which is bonded to the top of the main valve body 12.

As can best be seen in FIG. 2, the spring 20 is barrel-shaped with its top end tightly wrapped around the stem of the tilt element at the annular spring groove 27. A boss 30 corresponding to the input stem 13 extends upward from the bottom of the interior of the main valve body. The bottom of the spring 20 is tightly wrapped around the annular spring groove 32 of the boss 30. The spring 20 therefore supports the tilt element 21 at a point close to the central axis of the tilt valve. Therefore, the spring 20 will provide reduced resistance to tilting of the stem 16, and will permit a reduced stroke length for the stem 16, as will be described below.

The bottom 34 of the tilt element 21 is formed in the shape of a truncated cone having an elastomeric tip seal 24 at its truncated apex. The top of the bore 14 of the input stem 13, which corresponds to the top of the boss 30, has a bevelled circular configuration 36 which corresponds in shape and size to the tip seal 24 of the tilt element. In the unactuated position of FIG. 2, the surface 36 and the tip seal 24 are separated by a distance of less than 1 mm. Therefore, any axially downward movement of the stem 16 will cause the surface 36 and the tip seal 24 to form a seal which prevents the passage of fluid from the interior of the aerosol can to the interior of the main valve body 12 through the bore 14.

The radially peripheral surface 38 of the flange 25 of the tilt element 21 is provided with a bevel which conforms to the bevel 26 on the interior surface of the main valve body. The bevelled surfaces 26 and 38 are separated by less than 1 mm. Upon tilting of the valve stem 16, the beveled surfaces 26 and 38 will contact one another and limit the extent of tilting of the valve.

In use, the tilt valve assembly of the present invention is sealingly mounted in the top of a standard aerosol can in a conventional manner. As such, the bore 14 of the input stem 13 is exposed to the pressurized fluid within the can and the bore 28 of the output stem 16 is exposed to the atmosphere, or to a tube of a valve actuating device. Pressurized fluid from the aerosol can raises the fluid pressure in the chamber defined within the main valve body 12. The increased fluid pressure causes the rubber gland seal 15 to bulge slightly outward until an equilibrium position is established. In this position, the tilt element 21 is biased axially upwards so that the surfaces 23 are sealed by the seal washer 19. Therefore, pressurized fluid in the chamber within the main valve body cannot communicate with the bore 28 of the output stem 16.

If the stem 16 is subjected to a force F at an angle transverse to the axis of the main valve body, the stem 16 and the tilt element 21 will mutually pivot about point 40, thereby separating the top of the flange 25 from the washer 19. Accordingly, pressurized fluid from the interior of the main valve body can pass through the bore 28 of the output stem.

During this operation, it is important to note that the barrel shape of the spring 20 provides two important advantages. Since the spring 20 biases the tilt element 21 upward, it will resist the pivoting of the tilt element in the direction shown in FIG. 12. Because of the barrel shape of the spring 20, the resisting force will be applied at a distance $L_1$ from the point 40. If the spring were not barrel-shaped, on the other hand, the force resisting the tilting of the tilt element would be applied at a distance $L_2$ from the point 40, distance $L_2$ being greater than distance $L_1$. Therefore, the spring 20 provides reduced resistance torque to tilting than would a spring having a constant diameter equal to the diameter of the central portion of the spring 20. Yet, the spring 20 provides resistance to axial pressure which is substantially equal to that of such a spring lacking the barrel shape.

The barrel shape of the spring 20 also reduces the length of the stroke required to actuate the valve assembly. The barrel shape of the spring 20 results in the spring having reduced resistance to movements transverse to the axis of the valve body and spring. Therefore, the spring 20 will provide less resistance to a tendency for the flange 25 of the tilt element to shift in a direction opposite to the force F, due to the pivoting of the output stem 16. This results in the separation of the output stem 16 and the tilt element occurring at a stroke length which would be less than that necessary if the tilt element and its flange 25 were unable to shift transversely (to the right in FIG. 12). Thus, a force F transverse to the axis of the main valve body 12, such as would be applied by an automatic actuating device, is able to actuate the tilt valve assembly with a reduced force and a reduced stroke distance. This has the advantages of permitting a more compact actuating device and reducing the possibility of distortion of the output stem 16 and the seal 15.

However, if the output stem 16 is subjected to a force $F_1$ having an axial component, such as might be provided by manual actuation, the valve assembly could not be actuated. Under such circumstances, not only would the output valve assembly 16 and the tilt element 21 tilt, but the axial downward force would move the tilt element 21 downward so as to provide sealing contact between the surface 36 and the tip seal 24. This sealing contact would prevent communication between the interior of the aerosol can and the interior of the main valve body 12.

The extent to which the output stem 16 can be tilted is also limited by contact between the beveled edges 26 and 38 of the main valve body and the tilt element.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A release valve for a pressurized vessel, said valve comprising:

a hollow valve body defining a chamber therein, said valve body mounted in an opening of said vessel and forming a sealing closure for said opening of said vessel;

inlet means for communicating said chamber with the interior of said vessel;

outlet means for communicating said chamber with a region exterior to said vessel;

means for pressure sealing said chamber;

first means in said valve body for selectively opening and closing said outlet means; and means in said valve body for biasing said first means for opening and closing in a closing position, said means for biasing comprising a barrel-shaped spring extending between said valve body and said first means for opening and closing, said barrel shaped spring comprising a coil spring having a first end engaging said first means and a second end engaging a portion of said valve body, a diameter of a mid-portion of said spring is larger than a diameter of said first end and larger than a diameter of said second end.

2. The valve of claim 1 including second means for selectively opening and closing said inlet means, and means for biasing said second means for opening and closing in an opening position, wherein said first and second means for selectively opening and closing include portions fixed to one another and wherein said means for biasing said second means for opening and closing comprises said barrel-shaped spring.

3. The valve of claim 1 including means for limiting the movement of said first means for opening and closing.

4. The valve of claim 2 including means for limiting the movement of said first means for opening and closing.

5. A pressure valve for a pressurized vessel, said valve comprising:

a hollow valve body defining a chamber therein, said valve body having bottom and side walls, said valve body being mounted in an opening of said vessel and forming a sealing closure for said opening of said vessel, said bottom of said valve body being entirely in said vessel;

fluid inlet means fixed to said bottom, said fluid inlet means including an inlet aperture having a first axis;

elastic means for sealingly closing the top of said valve body;

fluid outlet means extending through, and movably supported by, said elastic means, said fluid outlet means including an outlet aperture having a second axis colinear with said first axis when said outlet means is in a first position;

a tilt element moveably held in said chamber and having a third axis, said tilt element being positionable in a first position wherein a first portion of said tilt element closes an end of said outlet aperture and said first, second and third axes are colinear; and means in said chamber for biasing said fluid outlet means and said tilt body in said first positions, said means for biasing comprising a barrel-shaped coil spring extending between said bottom and said tilt element, said spring having a fourth axis colinear with said first, second and third axes when said fluid outlet means and said tilt element are in said first position, wherein said barrel shaped coil spring has a first end engaging said tilt element and a second end engaging said bottom, and wherein a mid-portion of said spring has a diameter larger than a diameter of said first end and larger than a diameter of said second end.

6. The valve of claim 5 wherein said tilt element includes a portion which is movable into sealing contact with said inlet aperture when said tilt element is moved to a second position.

7. The valve of claim 5 wherein said tilt element comprises an axially extending shank portion and a radially extending flange portion, said first portion of said tilt element comprising the top surface of said flange portion.

8. The valve of claim 7 wherein one end of said coil spring is positioned in an annular groove in said shank portion of said tilt element.

9. The valve of claim 7 wherein the top of said inlet aperture includes a first bevelled surface, wherein the bottom of said shank portion of said tilt element includes a second bevelled surface corresponding to said first bevelled surface, and wherein said first and second bevelled surfaces are closely adjacent one another when said tilt element is in said first position, whereby axial movement of said tilt element closes said inlet aperture.

10. The valve of claim 7 wherein the radial periphery of said flange portion includes a third bevelled surface, wherein the side walls of said chamber include a fourth bevelled surface, and wherein said third and fourth bevelled surfaces are closely adjacent one another when said tilt element is in said first position, whereby the radial movement of said tilt element is limited.

11. The valve of claim 9 wherein the radial periphery of said flange portion includes a third bevelled surface, wherein the side walls of said chamber include a fourth bevelled surface, and wherein said third and fourth bevelled surfaces are closely adjacent one another when said tilt element is in said first position, whereby the radial movement of said tilt element is limited.

12. The valve of claim 7 wherein said fluid outlet means comprise:

an axially extending stem portion extending through an aperture of said elastic means; and a radially extending flange portion surrounding said end of said outlet aperture, said flange portion of said fluid outlet means including an annular seal element in surface contact with said first portion of said tilt element only when said outlet means and said tilt element are in said first position.

13. The valve of claim 9 wherein said fluid outlet means comprise:

an axially extending stem portion extending through an aperture of said elastic means; and a radially extending flange portion surrounding said end of said outlet aperture, said flange portion of said fluid outlet means including an annular seal element in surface contact with said first portion of said tilt element only when said outlet means and said tilt element are in said first position.

14. The valve of claim 10 wherein said fluid outlet means comprise:

an axially extending stem portion extending through an aperture of said elastic means; and a radially extending flange portion surrounding said end of said outlet aperture, said flange portion of said fluid outlet means including an annular seal element in surface contact with said first portion of said tilt element only when said outlet means and said tilt element are in said first position.

15. The valve of claim 11 wherein said fluid outlet means comprise:

an axially extending stem portion extending through an aperture of said elastic means; and a radially extending flange portion surrounding said end of said outlet aperture, said flange portion of said fluid outlet means including an annular seal element in surface contact with said first portion of said tilt element only when said outlet means and said tilt element are in said first position.

* * * * *